US011659920B2

(12) United States Patent
Werdowatz

(10) Patent No.: US 11,659,920 B2
(45) Date of Patent: May 30, 2023

(54) GRIP FOR A WIRE HANDLE

(71) Applicant: Jack Werdowatz, Temecula, CA (US)

(72) Inventor: Jack Werdowatz, Temecula, CA (US)

( * ) Notice: Subject to any disclaimer, the term of this patent is extended or adjusted under 35 U.S.C. 154(b) by 0 days.

(21) Appl. No.: 17/749,855

(22) Filed: May 20, 2022

(65) Prior Publication Data

US 2023/0036190 A1 Feb. 2, 2023

Related U.S. Application Data

(63) Continuation of application No. 29/800,305, filed on Jul. 20, 2021, now Pat. No. Des. 955,852.

(51) Int. Cl.
*A45F 5/10* (2006.01)

(52) U.S. Cl.
CPC ..... *A45F 5/102* (2013.01); *A45F 5/1046* (2013.01)

(58) Field of Classification Search
CPC ..... A45F 5/102; A45F 5/1046; A45F 2005/1033; A45F 2005/1053; A45F 2005/1073
USPC ..... 294/171
See application file for complete search history.

(56) References Cited

U.S. PATENT DOCUMENTS

| | | | | |
|---|---|---|---|---|
| 1,268,775 | A * | 6/1918 | Stanger | A45F 5/1046 220/759 |
| 1,468,848 | A | 9/1923 | Wear | |
| 1,576,546 | A | 3/1926 | Ransom | |
| 2,041,691 | A | 5/1936 | Becklin | |
| 2,364,105 | A | 12/1944 | Socke | |
| 2,444,558 | A | 7/1948 | Elliott | |
| 2,448,894 | A | 9/1948 | Laus | |
| 2,506,781 | A | 5/1950 | Elliott | |
| 2,846,714 | A | 8/1958 | Charlick | |
| 3,083,366 | A | 3/1963 | Franges | |
| 3,635,382 | A * | 1/1972 | Wilson | A45F 5/102 294/166 |
| 3,800,361 | A | 4/1974 | Stauffer | |
| 4,004,722 | A | 1/1977 | Olivier | |
| D300,506 | S | 4/1989 | Pedone | |
| 4,890,355 | A | 1/1990 | Schulten | |
| 4,902,060 | A | 2/1990 | Nobakht | |
| 4,923,235 | A | 5/1990 | Stewart | |

(Continued)

FOREIGN PATENT DOCUMENTS

| | | | | |
|---|---|---|---|---|
| GB | 2241161 A * | 8/1991 | | A45F 5/1046 |
| WO | WO-8806128 A * | 8/1988 | | A45F 5/1046 |
| WO | WO-9413171 A1 * | 6/1994 | | A45F 5/1046 |

*Primary Examiner* — Dean J Kramer
(74) *Attorney, Agent, or Firm* — Kirk A. Buhler; Buhler & Associates Patenting

(57) ABSTRACT

Improvements in a carrying handle cushion for a wire to provide a handle or grip for a wire handle of a bucket to increase the tactile surface area. The grip uses two gates on opposite sides of the handle where the wire handle (from the bucket) passes through the grip. The wire passes through a one-way lock that retains the handle to prevent the grip from being accidentally dislodged from the bucket wire. Lifting the handle on the wire will engage the handle using only the weight of a filled bucket. While a low amount of force can be applied to engage the grip onto the wire, the handle is not removed with an inverse force. Upon engagement of the grip there is an audible and tactile indication that the grip has been completely engaged on to the bucket wire.

20 Claims, 4 Drawing Sheets

(56) References Cited

U.S. PATENT DOCUMENTS

| | | | | |
|---|---|---|---|---|
| 4,982,989 | A * | 1/1991 | Sweeny | A45F 5/1046 294/171 |
| 5,029,926 | A | 7/1991 | Dieterich, Jr. | |
| D325,156 | S | 4/1992 | Sweeny | |
| D325,509 | S | 4/1992 | Cameron | |
| D329,973 | S | 10/1992 | Schuttinga | |
| D362,181 | S | 9/1995 | Meyers et al. | |
| D363,664 | S | 10/1995 | Muchnick | |
| D367,817 | S | 3/1996 | Halpin et al. | |
| D368,011 | S | 3/1996 | McCoy | |
| D369,549 | S | 5/1996 | Meyers et al. | |
| D369,745 | S | 5/1996 | Kitazaki | |
| D372,425 | S | 8/1996 | Kirkwood | |
| D372,865 | S | 8/1996 | Stowell et al. | |
| D374,621 | S | 10/1996 | Salazar, Jr. | |
| 5,601,327 | A * | 2/1997 | Cho | A45F 5/1046 D9/434 |
| D384,279 | S | 9/1997 | Hepworth | |
| D401,505 | S | 11/1998 | Michael et al. | |
| D403,035 | S | 12/1998 | MacPherson | |
| D430,029 | S | 8/2000 | Folmar | |
| D436,036 | S | 1/2001 | Manseau | |
| D440,492 | S | 4/2001 | Ellers | |
| D448,992 | S | 10/2001 | Bargsten et al. | |
| D456,264 | S | 4/2002 | Lalande | |
| D467,498 | S | 12/2002 | Taylor | |
| D489,976 | S | 5/2004 | Whitney | |
| D489,977 | S | 5/2004 | Robberstad | |
| D498,592 | S | 11/2004 | Kelley | |
| D566,546 | S | 4/2008 | Williamson | |
| D574,233 | S | 8/2008 | Young, Sr. | |
| D624,411 | S | 8/2010 | Puerta | |
| D647,801 | S | 11/2011 | Werdowatz | |
| D775,926 | S | 1/2017 | Atkins | |
| D778,706 | S | 2/2017 | Atkins | |
| D807,146 | S | 1/2018 | Werdowatz | |
| D814,264 | S | 4/2018 | Werdowatz | |
| D846,967 | S | 4/2019 | Werdowatz | |
| 10,875,682 | B1 * | 12/2020 | Laudon | B65D 25/32 |
| 2003/0102684 | A1 | 6/2003 | Shinmoto et al. | |
| 2005/0017530 | A1 | 1/2005 | Lima | |
| 2005/0258661 | A1 | 11/2005 | Castro | |
| 2005/0285421 | A1 | 12/2005 | Novakovich et al. | |
| 2006/0087139 | A1 | 4/2006 | Ayres | |
| 2006/0163894 | A1 | 7/2006 | Mishek et al. | |
| 2007/0024072 | A1 | 2/2007 | Leon | |
| 2007/0085360 | A1 | 4/2007 | Porter | |
| 2007/0187967 | A1 | 8/2007 | Smith | |
| 2007/0246959 | A1 | 10/2007 | Arcaro et al. | |
| 2008/0061574 | A1 | 3/2008 | Seki | |
| 2014/0292011 | A1 | 10/2014 | Liszkiewicz | |
| 2015/0257518 | A1 | 9/2015 | Burkman | |

* cited by examiner

GRIP FOR A WIRE HANDLE

CROSS REFERENCE TO RELATED APPLICATION

This application is a continuation-in-part of applicant's co-pending application Ser. No. 29/800,305 filed Jul. 20, 2021, the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a grip for a wire handle. More particularly, the present grip for a wire handle creates a one-directional handle that can be inserted and retained on a wire handle to increase the surface area from the wire that hold a bucket or other item.

Description of Related Art Including Information Disclosed Under 37 CFR 1.97 and 1.98

Paint and other items are often sold in buckets with a wire handle that allows a person to lift and transport the bucket. For paint in a 5 gallon bucket the weight of the bucket and contents can be 30 to 60 pounds, with some being higher. When a person lifts the wire handle, the weight of the bucket is placed on a fairly small cross-section of the wire. If the bucket of paint is simply transferred from a desk into a shopping cart the user only holds or lifts the bucket for a short period of time. If the purchaser needs to move the paint from a vehicle to a work site the purchaser may need to carry the bucket for an extended period of time. Increasing the surface area of the handle reduced some of the stress on fingers holding the wire handle.

A number of patents and or publications have been made to address these issues. Exemplary examples of patents and or publication that try to address this/these problem(s) are identified and discussed below.

U.S. Pat. No. 2,448,894 issued on Jul. 2, 1947 to Anthony J. Laus and is titled Shopping Bag Handle. This patent discloses a handle that is designed for use in connection with the usual cord handles of shopping bags. While this patent increases the surface area of the cord the handle is not configured to be secured to a wire paint bucket handle.

U.S. Pat. No. 4,890,355 issued on Jan. 2, 1990 to Elizabeth W. Schulten and is titled Releasably Mounted Handle Grip for Handles. This patent discloses a releasably mountable hand grip adapted to be mounted to a handle(s) associated with a plastic bag, totebag, collapsible luggage, briefcase and the like is disclosed. The hand grip includes an elongated tubular body having an inner and outer wall and opposite open ends. Opposed curvilinear sections form flexible wing sections to expand over an associated handle wider than the width of the longitudinal opening. While this patent is for a handle grip, the grip is not configured with a one-way to keep the handle retained.

U.S. Pat. No. 2,444,558 issued on Jul. 6, 1948 to A. E. Elliott and is titled Service Handle. This patent discloses a service handle for use in carrying market bags, bundles and other articles having cord handles. Cord handles or other handles of a similar nature which are frequently employed for carrying articles of considerable weigh that tend to cut and abrade the hand of the user. While this patent distributes the load of a carrying article it is a simple sector design that can easily fall off the carrying article.

What is needed is a handle grip for a wire handle. The grip for a wire handle disclosed in this document provides the solution.

BRIEF SUMMARY OF THE INVENTION

It is an object of the grip for a wire handle to provide a handle or grip for a wire handle of a bucket. The grip enlarges the surface area of the wire handle to increase the surface area of the wire to reduce the force per square inch where the load is carried. This will reduce the stress concentration on the handle and make it easier to carry the bucket for a longer period of time.

It is an object of the grip for a wire handle for the handle to have a plurality of finger wells. The finger wells provide the benefit of also spreading the contact surface area over more skin surface of the user. The finger wells also provide a tactile centering mechanism for the user to ensure they are gripping the handle at a central location. The finger wells also prevent the handle from slipping off a side of the handle. The finger wells are positioned and sized to provide a comfortable grip for an average user. Four finger wells for the four fingers of a user are used, but more or less than four finger wells are contemplated.

It is another object of the grip for a wire handle to have two gates on opposite sides of the handle where the wire handle (from the bucket) passes through the grip. Each of the sides of the handle have opposing guide walls that center the wire within the grip.

It is another object of the grip for a wire handle for the grip to have a one-way lock onto the wire bucket handle. A retention angle on the wire gate is used to make the engagement one-way. This prevents the grip from being accidentally dislodged from the bucket wire. Lifting the handle on the wire will engage the handle using only the weight of a filled bucket. While a low amount of force can be applied to engage the grip onto the wire, the handle is not removed with an inverse load without destructive removal.

It is another object of the grip for a wire handle to snap-onto the handle. The snap action provides and audible and tactile indication that the grip has been completely engaged on to the bucket wire. The snap action both opens around the wire handle and closes around the handle.

It is still another object of the grip for a wire handle to utilize flexing hinge mechanism that spreads the locking teeth to open the locking teeth and engage them around the wire from the bucket. For removal of the grip the sides of the grip are forcible spread to open the locking teeth the slid the wire outside of the grip.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
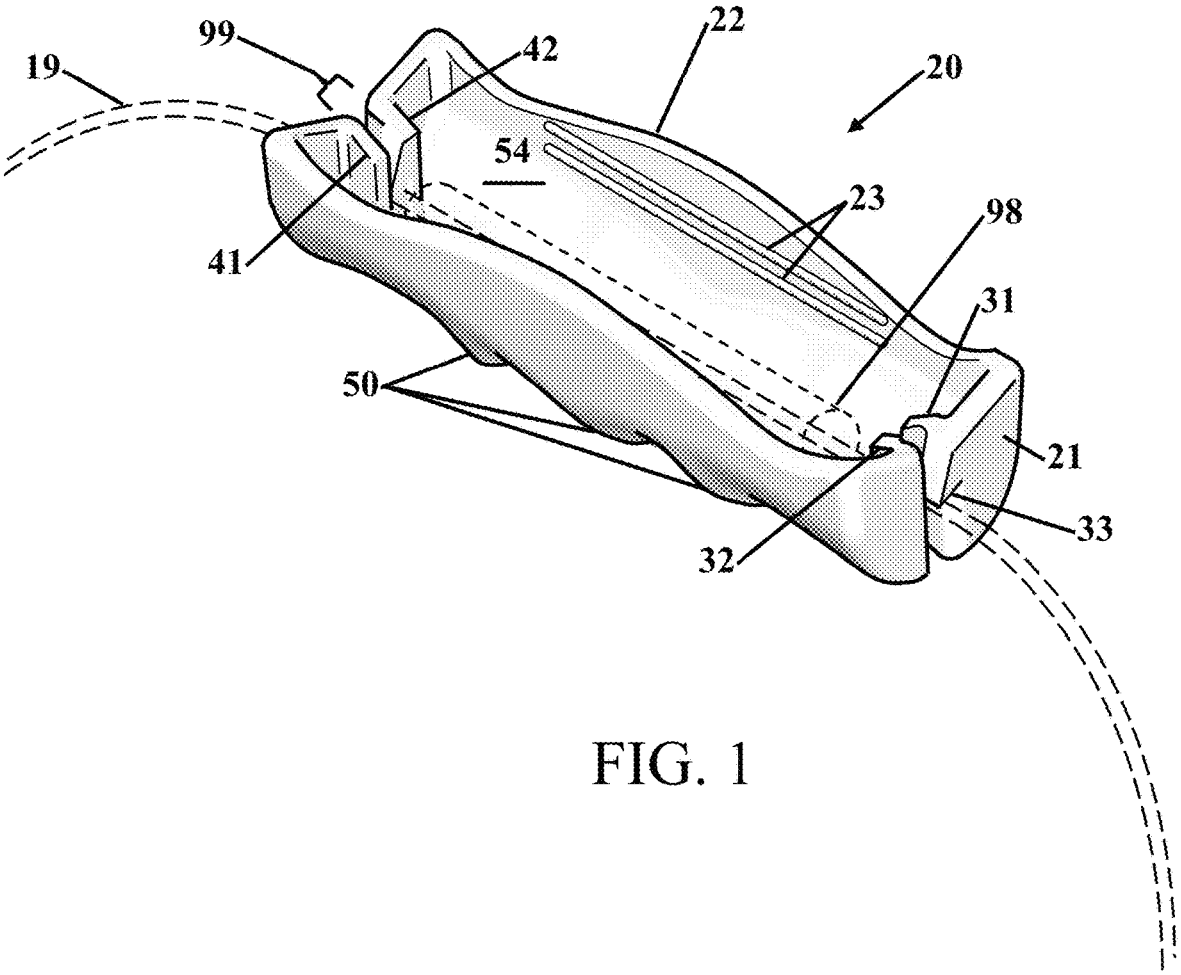
FIG. 1 shows a grip for a wire handle.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, but is merely representative of various embodiments of the invention. The illustrated embodiments of the invention will be best understood by reference to the drawings, wherein like parts are designated by like numerals throughout.

| Item Numbers and Description | |
|---|---|
| 19 wire handle | 20 grip for a wire handle |
| 21 end wall | 22 free upper edge |
| 23 undercut(s) | 31 guide wall |
| 32 inner gate | 33 outer gate |
| 41 guide wall | 42 inner gate |
| 43 outer gate | 50 finger divider |
| 51 slot | 52 wall |
| 53 wall | 54 cavity |
| 90 up | 91 spread |
| 92 return | 95 overlap |
| 93 force | 96 retention angle |
| 97 entry angle | 98 tube handle |
| 99 opening | |

FIG. 1 shows a grip for a wire handle 20. This view shows the grip for a wire handle 20 with an elongated body oriented where a hand of a user will grasp the underside of the grip for a wire handle 20 where the fingers of the user would spread around the finger dividers 50. In the embodiment shown there are three finger dividers 50 that are spaced to approximate the division between four fingers of a user (not shown). While three finger dividers 50 are shown and described, more than three or less than three are contemplated including having a smooth outer radius, or a ribbed outer wall. The finger dividers 50 allow for positioning the grip for a wire handle 20 within a hand and increase stability to prevent the grip for a wire handle 20 from sliding out of the hand of the user.

This figure also shows wire of a wire handle 19 from a paint bucket or wire handle on other apparatus that is carried. There is an opening 99 in the grip for a wire handle 20 that allows the wire handle 19 to pass into the grip for a wire handle 20 and be secured. The wire handle 19 passes through to a lower portion of the grip for a wire handle 20 to prevent rotation of the grip for a wire handle 20 while the load is being moved. Within the grip for a wire handle 20 a tube handle 98 is shown. Some wire handles 19 are sold with a small plastic tube handle 98. The grip for a wire handle 20 is configured for the tube handle 98 to fit within the central opening of the grip for a wire handle 20. An upper free edge 22 extends around the sides of an open cavity 54 of the grip for a wire handle 20 and connects on the end wall(s) 21 where gates create a path and a locking mechanism to retain the wire handle 19. Under the upper free edge 22 one or a plurality of raised undercut(s) 23 are shown but could have no undercuts. These undercut(s) 23 allow a plastic grip for a wire handle 20 to be retained in an injection molding machine until it is ejected.

Each end wall 21 has an inner gate 32, 42 and an outer gate 33 that retains the wire handle 19. The gates and function are shown and described on more detail in other figures herein. Within the gate area are also guide walls 31 and 41 that guide the wire handle through the grip for a wire handle 20.

Figure 2:
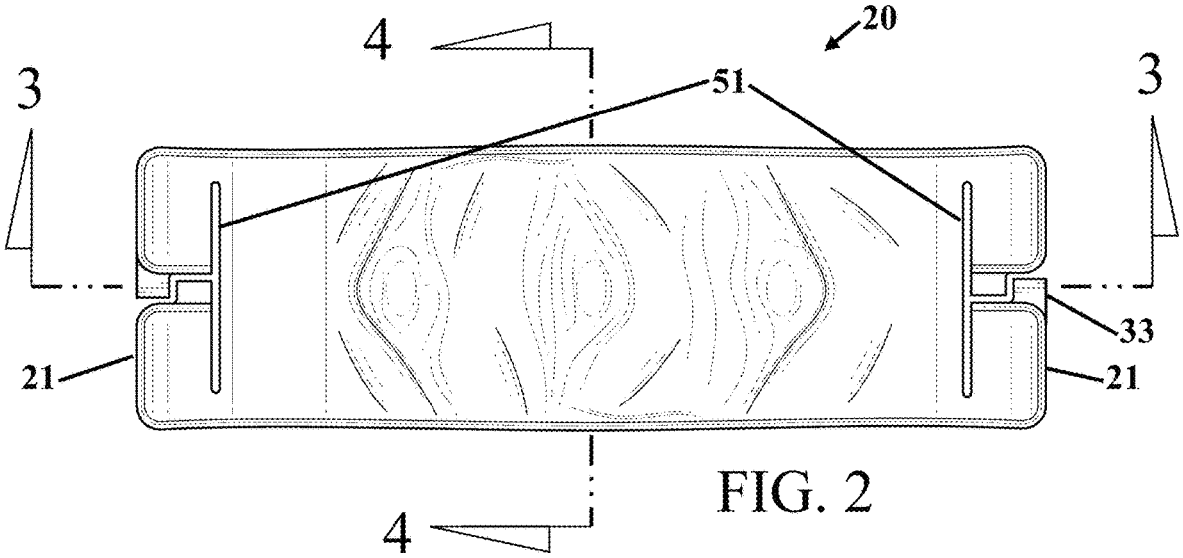
FIG. 2 shows a bottom plan view of the grip for a wire handle.
Figure 3:
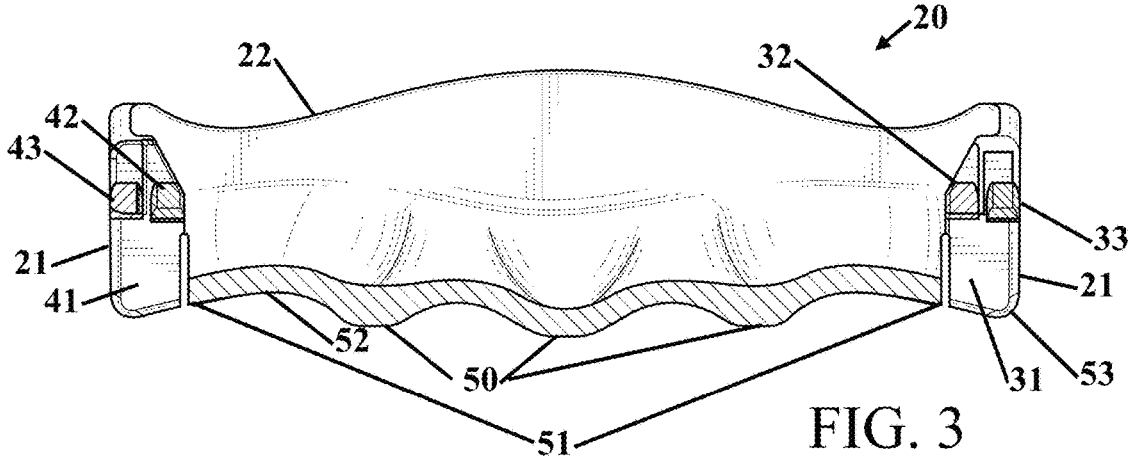
FIG. 3 shows a side sectional view taken along lines 3-3 from FIG. 2.
Figure 4:
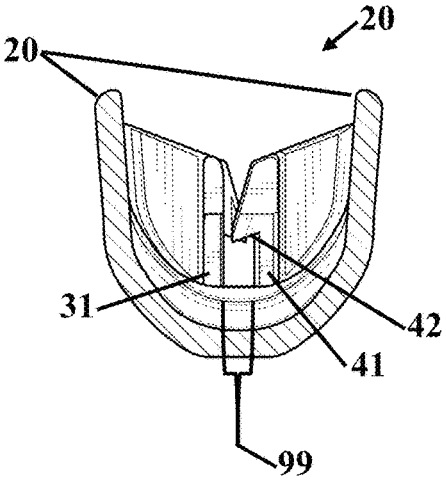
FIG. 4 shows a mid-sectional view taken along lines 4-4 from FIG. 2.

FIG. 2 shows a bottom plan view of the grip for a wire handle 20, FIG. 3 shows a side sectional view taken along lines 3-3 from FIG. 2 with the free upper edge 22 and FIG. 4 shows a mid-sectional view taken along lines 4-4 from FIG. 2. These figures show the retaining features that retain the wire handle within the grip for a wire handle 20 and the flexing mechanism that allows the retaining mechanism to open and close around the wire. FIG. 2 is the portion of the grip for a wire handle 20. From this figure slots 51 are shown that allow for the retaining features to hinge, flex or open for the wire to pass into the grip for a wire handle 20. While the slots 51 are shown as linear features, they may be curved or not necessary in some embodiments. From FIG. 3 the different wall 52 at the finger divider(s) 50 and wall 53 thicknesses are shown between the portion in the hand of the user and the side areas where the wall 53 may be thinner to allow for the gates to flex open and return to their normal position where the wire is retained in the opening 99.

From FIG. 3, each side of the grip for a wire handle 20 has end walls 21 with the wall 53 thickness. One side has an outer gate 33, 43 and the opposing side has an inner gate 32, 42. While the figure shows gates on each side, it is contemplated that the grip for a wire handle 20 could be constructed with a gate on only one side of the grip for a wire handle 20. From FIG. 4 the guide walls 31 and 41 are shown parallel to the opening 99.

Figure 5:
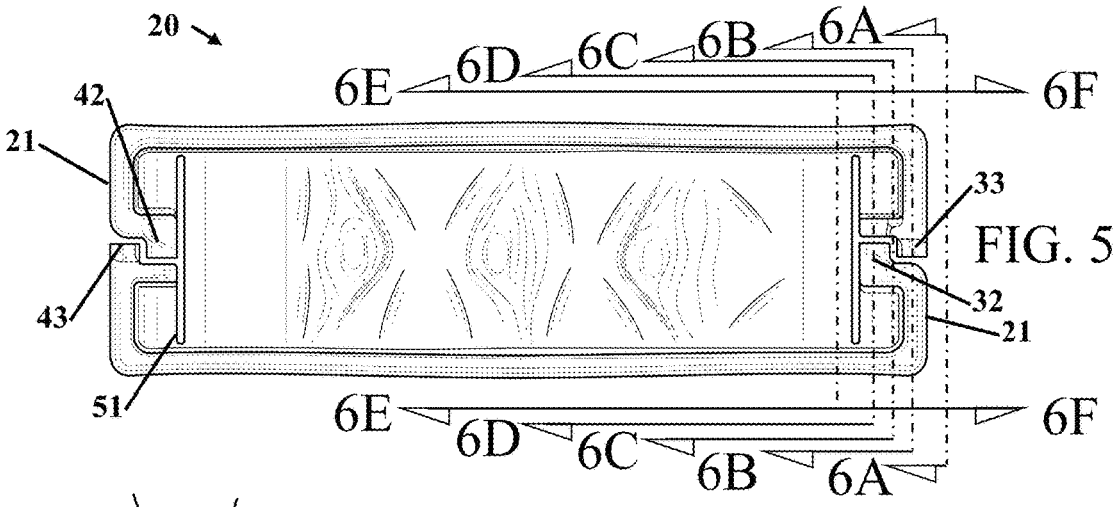
FIG. 5 shows a top plan view of the grip for a wire handle.
Figure 6A:
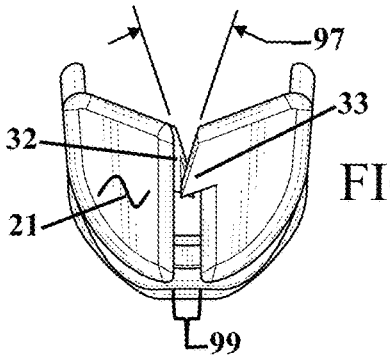
FIG. 6A-6F show sectional views taken along lines 6A-6F from FIG. 5.

FIG. 5 shows a top plan view of the grip for a wire handle 20 and FIG. 6A-6F show sectional views taken along lines 6A-6F from FIG. 5. From the end view, FIG. 6A shows the end wall 21 with the opening 99 on the bottom portion of this view. The outer gate 33 is shown on the end wall 21 with a portion of the inner gate 32 being visible. At the center top of this view the entry angle 97 where a wire is inserted is shown. This entry angle 97 is between 10 degrees and 170 degrees and provides a ramp to spread the outer gate 33 and the inner gate 32 to let the wire pass into the opening 99.

Figure 6B:
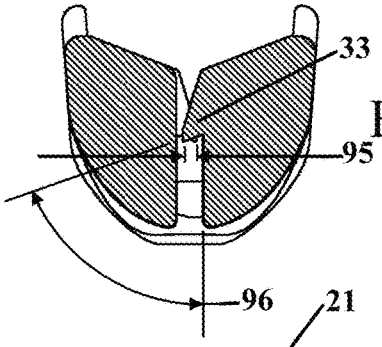
Figure 6C:
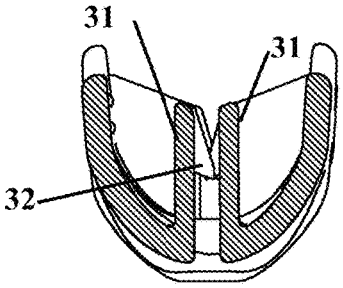
Figure 6D:
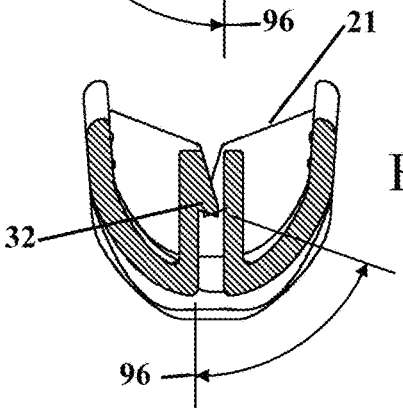
Figure 6E:
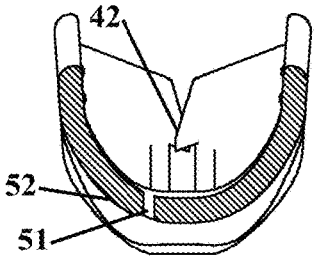
Figure 6F:
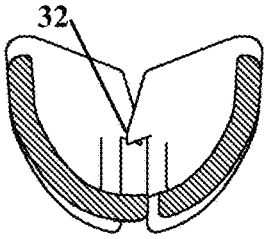

In FIG. 6B the retention angle 96 on the outer gate 33 is shown the retention angle 96 is between 10 degrees and 90 degrees. The retention angle holds the wire (not shown) within the opening 99. There is also a slight overlap 95 between the inner gate and the outer gate to assist in retaining the wire within the opening 99. In FIG. 6C the guide walls 31 are shown outside of the outer gate and the inner gate 32. In FIG. 6D the opposing retention angle of the inner gate 32 is shown. In the preferred embodiment the retention angles of the inner gate and the outer gates are the same, but they could be different angles. The opposing end wall 21 of the grip for a wire handle 20 is shown. In FIG. 6E the cross-section is through the gates and the inner gate 42 of the opposing side is visible. This figure also shows a different version and location of the slot 51 in the wall 52. In FIG. 6F the view is opposite of FIG. 6E showing the inner gate 32.

Figure 7A:
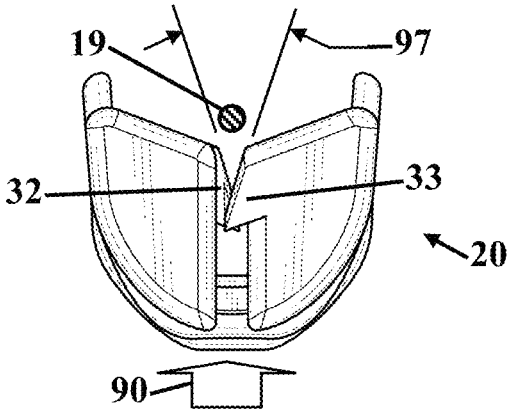
FIG. 7A-7D show end views of the grip for a wire handle with a wire transitioning into the grip for a wire handle.
Figure 7B:
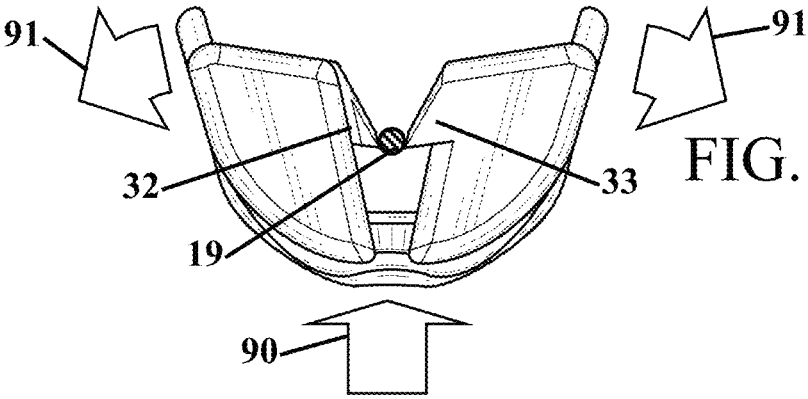

FIG. 7A-7D show end views of the grip for a wire handle 20 with a wire transitioning into the grip for a wire handle 19. In FIG. 7A the wire handle 19 is shown entering into the grip for a wire handle 20. The up force 90 from lifting the grip for a wire handle 20 into the wire handle 19 presses into the entry angle 97 to spread the outer gate 33 and the inner gate 32. In FIG. 7B the grip for a wire handle 20 is shown spread 91 where the wire handle 19 is forced down and clears the edges of the outer gate 33 and the inner gate 32.

Figure 7C:
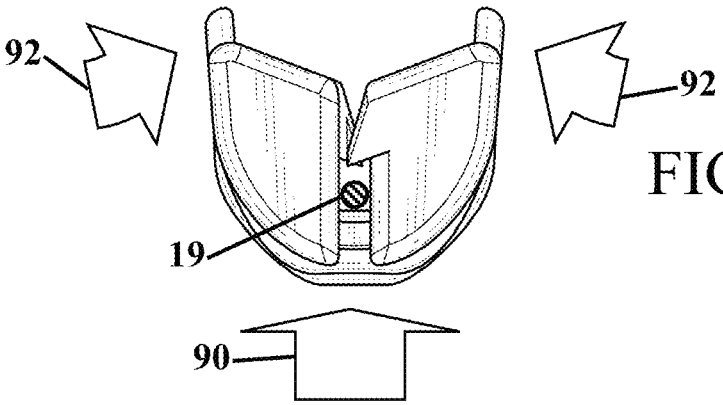
Figure 7D:
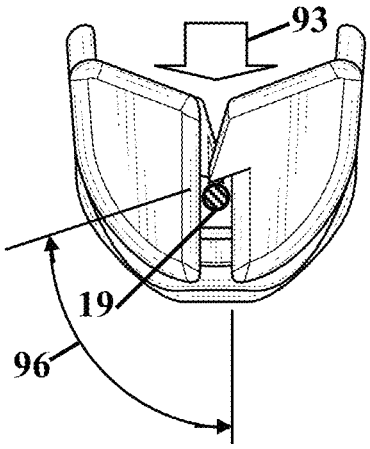

If FIG. 7C the end of the grip for a wire handle 20 spring back and return 92 to their normal position, thereby retaining the wire handle 19 within the grip for a wire handle 20. In FIG. 7D the wire handle 19 is retained and the retention angle 96 of the inner gate and the outer gate prevent the wire handle from being returned 92 out of the grip for a wire handle 20 unless the side walls of the grip for a wire handle 20 are manually spread to a condition shown in FIG. 7B.

Thus, specific embodiments of a grip for a wire handle have been disclosed. It should be apparent, however, to those skilled in the art that many more modifications besides those described are possible without departing from the inventive concepts herein. The inventive subject matter, therefore, is not to be restricted except in the spirit of the appended claims.

SEQUENCE LISTING

Not Applicable.

The invention claimed is:

1. A grip for a wire handle comprising:

an elongate body having an open cavity formed therein for receiving a portion of an elongate handle of an item to be carried;

the elongate body having end walls on each end of said elongated body;

each end wall having an end wall opening whereby said portion of said elongated handle is configured to fit therethrough;

both sides of each end wall opening further includes at least one gate wherein each end has an outer gate that is opposed to an inner gate and at least a portion of said outer gate overlaps at least a portion of said inner gate;

said inner gate is offset from said outer gate to leave a clearance between said inner gate and said outer gate, and said outer gate and said inner gate include an entry angle and a retention angle.

2. The grip for a wire handle according to claim 1, wherein said entry angle is configured to spread said overlap of said outer gate and said inner gate thereby creating an opening between said outer gate and said inner gate.

3. The grip for a wire handle according to claim 2, wherein said entry angle is configured to open said grip with a weight of a bucket.

4. The grip for a wire handle according to claim 1, wherein said retention angle is configured to retain said portion of an elongate handle of an item to be carried.

5. The grip for a wire handle according to claim 1, wherein said portion of an elongate handle of an item to be carried is a wire handle of a bucket.

6. The grip for a wire handle according to claim 5, wherein said grip for a wire handle is removed from said wire handle by spreading open said at least one gate.

7. The grip for a wire handle according to claim 5, wherein said end wall opening has a clearance opening for said wire handle.

8. The grip for a wire handle according to claim 5, further includes a clearance for a tube handle on said wire handle of a bucket.

9. The grip for a wire handle according to claim 5, wherein overlap is smaller than said wire handle.

10. The grip for a wire handle according to claim 1, further includes at least one finger divider.

11. The grip for a wire handle according to claim 10, wherein there are three finger dividers.

12. The grip for a wire handle according to claim 1, wherein said inner gate and said outer gate include an entry angle between 10 degrees and 170 degrees.

13. The grip for a wire handle according to claim 1, wherein said inner gate and said outer include a retention angle between 10 degrees and 90 degrees.

14. The grip for a wire handle according to claim 1, includes at least one finger well.

15. The grip for a wire handle according to claim 14, includes four finger wells.

16. The grip for a wire handle according to claim 1, wherein said grip for a wire handle is made from injection molded plastic.

17. The grip for a wire handle according to claim 1, further includes at least one slot in a bottom wall of said elongated body that is configured to act as a hinge for said at least one gate.

18. The grip for a wire handle according to claim 1, wherein said overlap is smaller than said end wall opening.

19. A grip for a wire handle comprising:

an elongate body having an open cavity formed therein for receiving a portion of an elongate handle of an item to be carried;

the elongate body having end walls on each end of said elongated body;

each end wall having an end wall opening whereby said portion of said elongated handle is configured to fit therethrough;

both sides of each end wall opening further includes at least one gate wherein each end has an outer gate and an inner gate and at least a portion of said outer gate overlaps at least a portion of said inner gate;

further includes at least one slot in a bottom wall of said elongated body that is configured to act as a hinge for said at least one gate, and said outer gate and said inner gate include an entry angle and a retention angle.

20. The grip for a wire handle according to claim 19, wherein said entry angle is configured to spread said overlap of said outer gate and said inner gate thereby creating an opening between said outer gate and said inner gate.

* * * * *